United States Patent [19]

Pearson

[11] 4,068,590

[45] Jan. 17, 1978

[54] MEANS FOR CONTROLLED FRAGMENTATION

[75] Inventor: John Pearson, China Lake, Calif.

[73] Assignee: The United States of America as represented by the Secretary of the Navy, Washington, D.C.

[21] Appl. No.: 67,245

[22] Filed: Aug. 26, 1970

[51] Int. Cl.[2] ..... F42B 13/48

[52] U.S. Cl. ..... 102/67

[58] Field of Search ..... 102/64, 67

[56] References Cited

U.S. PATENT DOCUMENTS

| | | | |
|---|---|---|---|
| 109,600 | 11/1870 | Drake | 102/67 |
| 1,628,527 | 5/1927 | Brandt | 102/49.2 |
| 3,566,794 | 3/1971 | Pearson | 102/67 |

FOREIGN PATENT DOCUMENTS

| | | | |
|---|---|---|---|
| 555,279 | 3/1957 | Belgium | 102/67 |

*Primary Examiner*—Verlin R. Pendegrass
*Attorney, Agent, or Firm*—R. S. Sciascia; Roy Miller

[57] ABSTRACT

A method for manufacturing a fragmentation device which upon fragmenting produces uniform sized fragments of a predetermined shape and mass. The device is useful in antipersonnel and antimateriel systems which require uniformly sized fragments and where impact patterns having a fairly uniform distribution and predictable area coverage are needed.

9 Claims, 7 Drawing Figures

INVENTOR.
JOHN PEARSON
BY ROY MILLER
ATTORNEY.

MEANS FOR CONTROLLED FRAGMENTATION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention relates to a fragmentation device and to the method of manufacture, more particularly, to a device for antipersonnel and antimateriel systems which produces fragments of predetermined mass and shape.

Applied research studies conducted a decade ago demonstrated that the fragmentation behavior of a warhead case was affected by a grid system machined or formed on the inner surface of the metal case. When the warhead was detonated, the elements of the grid system acted as dynamic stress raisers and introduced localized regions of high stress concentrations in the case resulting in the initiation of shear fractures in a definite pattern. Once initiated, these fractures propagated along predetermined paths defined by the maximum shear trajectories of the stress field. Feasibility studies regarding the use of inner surface grid systems demonstrated their value in fragmentation warheads, and a production method for producing warhead cases of this type by a hot-cup, cold-draw process was devised. An understanding of the design relationships for use with the method has remained limited, restricted mainly to information obtained from the original studies and to an extrapolation of behavior data based on a quantitative understanding of the response of metals to impulsive loads. The prior art provided for an internal grid structure comprising large diamond grids with symmetrical profile. Fragmentation of steel cases having this structure produces fragments having a variety of shapes and sizes, and the impact pattern is of a nonuniform area coverage. The present invention overcomes this undesirable pattern by providing a device which upon fragmentation produces an impact pattern with a fairly uniform area distribution. The fragments produced are of predetermined mass and shape. Accordingly, it is an object of this invention to provide a means for closer control of fragmentation of impulsively loaded bodies than the means of the prior art.

DESCRIPTION OF THE INVENTION

Figure 1:
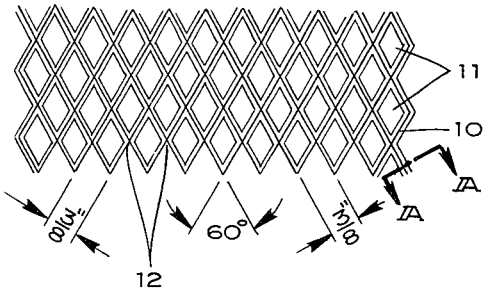
FIG. 1. (PRIOR ART)
FIG. 1 is a sketch of a detailed grid pattern showing the prior art.
Figure 1A:
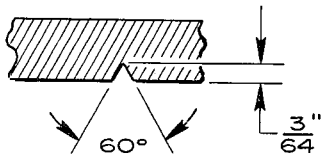
FIG. 1A. (PRIOR ART)
FIG. 1A is a detailed cross-section taken through line A — A of FIG. 1 showing a symmetrical grid profile.

Referring now to the drawing wherein like reference characters designate like or corresponding parts throughout the several views, FIG. 1 illustrates the prior art wherein there is shown the inner wall pattern of a fragmentation casing having grooves or indentations 10 which form a diamond pattern grid designated generally by numeral 11. The pattern is based on a 60-degree included angle 12 for the diamond grid pattern 11 as shown. The grid spacings are ⅜-inch. The cross section of each grid element of the prior art shown in FIG. 1A taken through line A — A of FIG. 1 is symmetrical with the 60-degree "V" notch 12 and has a depth of 3/64-inch.

Figure 2:
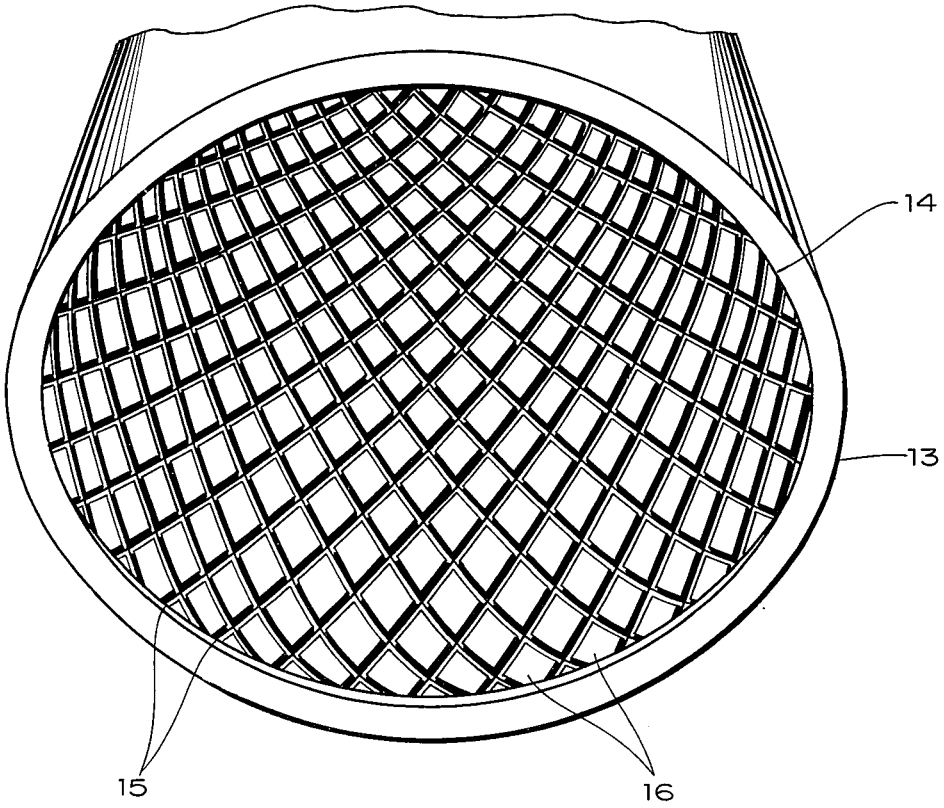
FIG. 2 is an end view of a cylinder showing the grid pattern in accordance with this invention.
Figure 3:
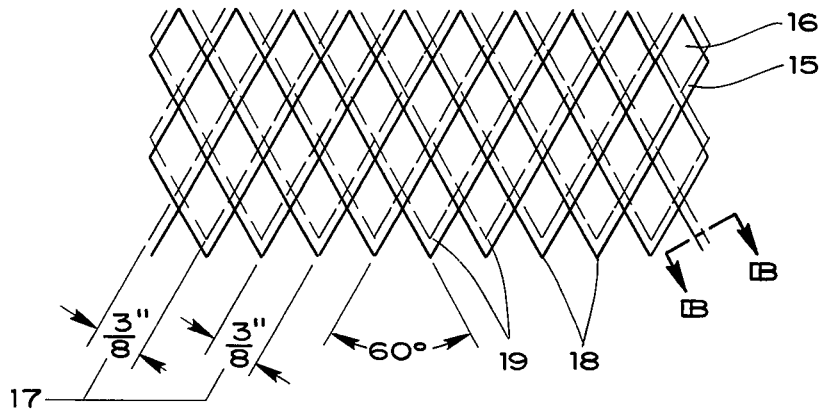
FIG. 3 is a sketch of the grid pattern on the inner surface of the cylinder.
Figure 3B:
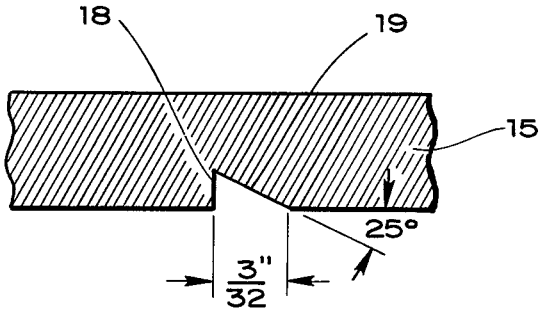
FIG. 3B is a detailed cross-section taken through line B — B of FIG. 3 showing a nonsymmetrical profile.

A preferred embodiment of this invention as shown in FIG. 2 illustrates the new grid pattern from an end view of a cylinder 13 wherein the inner wall 14 is provided with grooves or indentations 15 in the inner surface forming a diamond shaped grid 16. The grid profile of this invention is better shown in FIG. 3 which diagrammatically illustrates the inner wall pattern of cylinder 13. A diamond pattern is shown having ⅜-inch grid spacings 17 but other dimensions, both greater and smaller, may be used. The grid profile is asymmetrical, having a steep side 18 and a shallow side 19. Steep side 18 is perpendicular to the tangent to the inner surface of the wall and shallow side 19 forms an angle of about 25 degrees with respect to the tangent to the inner surface of the wall. In the present invention the grid system was machined on the inner surface of each cylinder using a universal milling machine. However, the grid system can also be produced by other conventional metalworking techniques such as rolling, stamping, pressing, etc.

The casing is conventionally made of low carbon steel which fractures readily in shear and is low priced, but many other metals may be used. The control method is most effective when the thickness of the casing is such that the primary mode of fragmentation is that of shear. This behavior is normally governed by the engineering properties of the metal and the explosive charge-to-metal ratio of the device.

In the prior art the thickness of the wall was specifically related to the groove spacing on the wall so that in general, a given wall thickness was restricted to one set of grid pattern dimensions. With the current invention the grid spacings on the wall are no longer restricted to a single value for any given wall thickness. Rather, grid systems with a wide range of groove spacings can be appropriately used with a given wall thickness, thus allowing the warhead designer greater choice in the predetermined fragment size he wishes to use.

Figure 4:
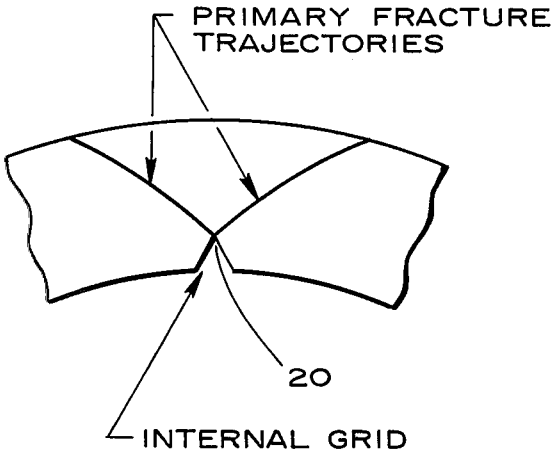
FIG. 4. (PRIOR ART)
FIG. 4 is a cross-sectional view of an element of an inner surface grid with symmetrical profile (prior art) showing symmetrical nature of primary trajectories of fracture.
Figure 5:
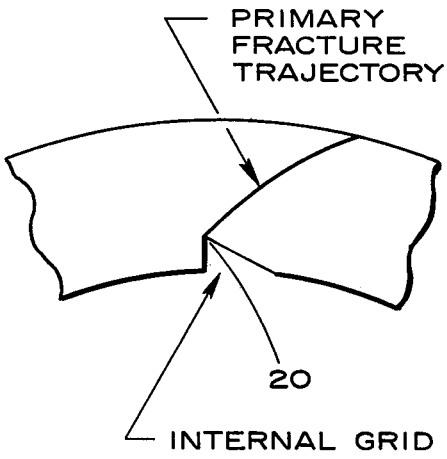
FIG. 5 is a cross-sectional view of an element of an inner surface grid with nonsymmetrical profile, in accordance with present invention, showing single controlled orientation of primary fracture trajectory.

During the expansion of a cylinder maximum strain occurs in the circumferential direction. The grid machined or formed on the inner surface or wall of the cylinder, or on a flat sheet later rolled into a cylinder, makes use of the stress system existing in the wall, and enhances the natural mode of fragmentation by predetermining the location of the shear fractures. In a plane normal to the longitudinal axis of the wall, the trajectories of maximum shear occur at approximately 45° to the tangent to the inner surface of the wall, and within the wall the trajectories are mutually orthogonal. It is these trajectories which the shear fractures follow when propagating through the cylinder wall. Once a fracture is initiated at the root 20 of a grid element as shown in FIGS. 4 and 5, the fracture has the option of propagating along either the left or right trajectory, or possibly both. Which fracture option is exercised depends on the symmetry of the system. For example, where the grid has a symmetrical profile, as shown in the prior art FIGS. 1 and 1A, the tendency is to propagate fractures on both trajectories (labeled primary fracture trajectories in FIG. 4), thus producing large numbers of pyramidal shaped fragments. When this happens, the remainder of the cylinder material located between the sides of the pyramids comes free, normally as small fragments. However, when one of the fractures did not propagate completely, some of the adjacent metal would remain attached to the pyramid. This action, with the numerous possible combinations of fracture propagation accounts for the variety of shapes and masses of the fragments along with nonuniform area coverage.

The fracture behavior shown in FIG. 5 with the asymmetrical profile grid in accordance with the present invention was extremely consistent. Apparently because of the asymmetrical nature of the profile, the tendency was to initiate only one fracture path with each grid element or profile. Because of the consistency in the directions of fracture propagation, the fragment size and shape was quite uniform. With these results, predictable fragment size is now possible.

Many tests were conducted on the device produced by the method disclosed herein and where the explosive was detonated so as to sweep into both the steep and shallow faces of the asymmetrical profile grids, firing into the shallow face produced the greater number of fragments in the predetermined range.

The method of manufacturing the fragmentation device herein disclosed comprises selecting a material (such as low carbon steel) having a cylindrical wall thickness such that the device fragments predominantly in shear, then forming by suitable means such as machining or cutting, a plurality of intersecting stress raising grooves, or indentations on the inner wall or surface of the cylinders in the form of a diamond pattern grid. The diamond grid is formed by cutting one set of parallel helical grooves and then cutting another set angularly disposed to the first set. The parallel helical grooves are spaced apart some predetermined distance such that 60-degree lines drawn from adjacent grooves will intersect. The diamond pattern is thus formed by intersecting grooves having asymmetrical profiles having been cut to have a steep and shallow side.

What is claimed is:

1. A method of manufacturing a single-walled cylinder so that upon fragmentation thereof uniform sized fragments of a predetermined shape and mass are produced which comprises forming indentations on the inner surface of the cylinder corresponding to a diamond-shaped pattern, said pattern having the major axis of the diamonds disposed parallel to the longitudinal axis of the cylinder; and the walls of said indentation having a steep and shallow side respectively.

2. The method according to claim 1 wherein the diamond shaped pattern is based on a 50 to 70-degree included angle.

3. The method according to claim 2 wherein said steep side is perpendicular to the tangent to the inner surface.

4. The method according to claim 3 wherein the shallow side forms an angle of about 25° with respect to the tangent to the inner surface.

5. The method according to claim 1 wherein said indentations are formed on a flat sheet which is subsequently rolled into a cylinder.

6. A controlled fragmentation device comprising a cylinder composed of a fracturable material having inner walls on which are disposed intersecting indentations in the form of a diamond shaped pattern;

said pattern having the major axis of the diamonds disposed parallel to the longitudinal axis of said cylinder; and the cross section of each indentation being disposed asymmetrically with the included angle of said diamond having a steep and a shallow side respectively.

7. The device in accordance with claim 6 wherein said material is low carbon steel.

8. The device in accordance with claim 6 wherein said diamond-shaped pattern is based on a 50 – 70-degree included angle.

9. The device in accordance with claim 8 wherein said steep side is disposed perpendicular to the tangent of the inner wall surface and said shallow side is disposed at an angle of about 25 degrees with respect to the tangent to the inner wall surface.

* * * * *